US005161334A

United States Patent [19]

Schaal et al.

[11] Patent Number: 5,161,334

[45] Date of Patent: Nov. 10, 1992

[54] HAND POWER TOOL WITH A MULTI-PART, MANUALLY OPERABLE QUICK-ACTION CHUCK

[75] Inventors: Günter Schaal, Stuttgart; Walter Barth, Leinfelden-Echterdingen; Gerd Berner, Stuttgart, all of Fed. Rep. of Germany

[73] Assignee: Robert Bosch GmbH, Stuttgart, Fed. Rep. of Germany

[21] Appl. No.: 700,122

[22] PCT Filed: Oct. 26, 1989

[86] PCT No.: PCT/DE89/00687

§ 371 Date: May 24, 1991

§ 102(e) Date: May 24, 1991

[87] PCT Pub. No.: WO90/06210

PCT Pub. Date: Jun. 14, 1990

[30] Foreign Application Priority Data

Jul. 12, 1988 [DE] Fed. Rep. of Germany ..... 3841181

[51] Int. Cl.[5] ..... B24B 45/00

[52] U.S. Cl. ..... 51/168; 83/666; 83/698

[58] Field of Search ..... 51/168, 209 R, 376, 51/377, 378, 170 R, 170 PT, 170 T; 403/24, 259; 83/666, 698

[56] References Cited

U.S. PATENT DOCUMENTS 4,955,744 9/1990 Barth et al. ..... 51/168

FOREIGN PATENT DOCUMENTS 0231500 8/1987 European Pat. Off. .
3012836 9/1985 Fed. Rep. of Germany ..... 51/168
3831236 3/1990 Fed. Rep. of Germany ..... 51/168
8805366 7/1988 Int'l Pat. Institute .
8805386 7/1988 Int'l Pat. Institute .
8806075 8/1988 Int'l Pat. Institute .
0825877 12/1959 United Kingdom .
0967516 8/1964 United Kingdom .

*Primary Examiner*—Roscoe V. Parker
*Attorney, Agent, or Firm*—Michael J. Striker

[57] ABSTRACT

For a hand power tool (1) with a multi-part manually operable quick-action chuck (2) for a disc-shaped tool (3) which is held on a shoulder (4) of a drive spindle (5) and onto which a force can be loaded from the other side by a pressure plate (7), with the pressure plate (7) concentrically embracing a threaded part (13) and being arranged positionally secured in relation to the threaded part and rotatable, with a hand screw part (11) embracing the threaded part (13) and th pressure plate (7) like a sleeve, and forming an annulus (14) with these, which contains at least a rolling contact bearing (9) and a drive which couples together the hand screw part (11), the threaded part (13), and the pressure plate (7), for improved function and a simplified design, and for a limitation of the maximum clamping pressure on the tool, a rolling planetary drive is formed from at least one of the rolling contact bearings (9, 12) in conjunction with a springly element (10), the drive which couples the pressure plate (7), the threaded part (13), and the hand screw part (11).

11 Claims, 2 Drawing Sheets

HAND POWER TOOL WITH A MULTI-PART, MANUALLY OPERABLE QUICK-ACTION CHUCK

BACKGROUND OF THE INVENTION

The invention concerns a hand power tool with a multi-part, manually operable quick-action chuck for disc shaped tools. These hand power tools are mainly grinding machines. Such a machine is known with a quick-action chuck in accordance with the PCT application DE 87/00577. In the known machine, the disc shaped tools are held on one side against a shoulder of a drive spindle, and on the other side, they are subject to loading from a pressure plate of a chuck. The pressure plate concentrically embraces a threaded part which is axially secured in its position and arranged so that it can be rotated. A hand screw part embraces the pressure plate like a sleeve and, with the pressure plate, forms an annulus in which at least one rolling contact bearing and a drive which couples the hand screw part, the threaded part, and the pressure plate. During screw fixing and tightening of the chuck, the pressure plate is pressed axially against the tool, and the tool is thus pressed against the shoulder on the spindle side. Automatic tightening of the chuck occurs as the hand power tool is switched on. The drive facilitates a transmission with torque increase on tightening. The torque increase will also be effective during slackening of the chuck, by turning the hand screw part, whereby the friction contact between the pressure plate and the tool is cancelled. As soon as this friction contact ceases, the chuck as a whole can be loosened.

A disadvantage of the known hand power tool is a relatively high and uncontrollable chucking power between the pressure plate and the tool due to the automatic chucking during operation of this machine. A further disadvantage is the complicated design of the chuck which is susceptible to faults. Vibrations and dust, in particular, degrade the efficiency of the drive.

SUMMARY OF THE INVENTION

According to the invention, in a hand power tool of the above described type, the chuck has a rolling planetary drive, particularly a recirculating ball drive. This drive couples the hand screw part and the threaded part and the pressure plate.

The following advantages result for the hand power tool of this invention. Following a tool change without any ancillary tools with subsequent operation of the hand power tool, the chucking forces acting on the tool are defined and limited by the recirculating ball drive which acts like a friction clutch. The drive of the chuck is insensitive to dust and vibrations and can be easily cleaned even in its assembled state. It is further possible to retrofit the chuck of the hand power tool which is the subject of this invention, to other existing hand power tools with disc shaped tools, without any particular modification being required.

In one embodiment of the invention, at least one of the rolling contact bearings and spring means, advantageously a spring disc, forms a drive element, which couples the pressure plate, the threaded part and the hand screw part. The rolling contact bearing advantageously has rolling bodies and the rolling bodies are coupled with the threaded part so as to provide transmission of movement. There is a frictional connection between the threaded part and a rolling contact bearing, and also between the rolling bodies of the bearing and the pressure plate. The threaded part is fitted with a retaining ring in the area which is concentrically embraced by the pressure plate. The annulus is sealed in a friction contact by sealing rings placed in grooves, advantageously one in the threaded part and one in the pressure plate.

Advantageously, there are two rolling contact bearings in the chuck, one of which is an axial ball bearing resting against the pressure plate. This axial ball bearing runs on a front face of the disc spring. The other rolling contact bearing is an axial roller bearing resting against a threaded part, which axial roller bearing runs on another front face of the disc spring.

In another embodiment of the invention there are two disc springs provided. One of the disc springs is formed as a one-piece projection of the hand screw part, and the other disc spring (braced between the threaded part and the axial roller bearing and at the same time provides a running surface for the axial roller bearing.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE EMBODIMENTS

Figure 1:
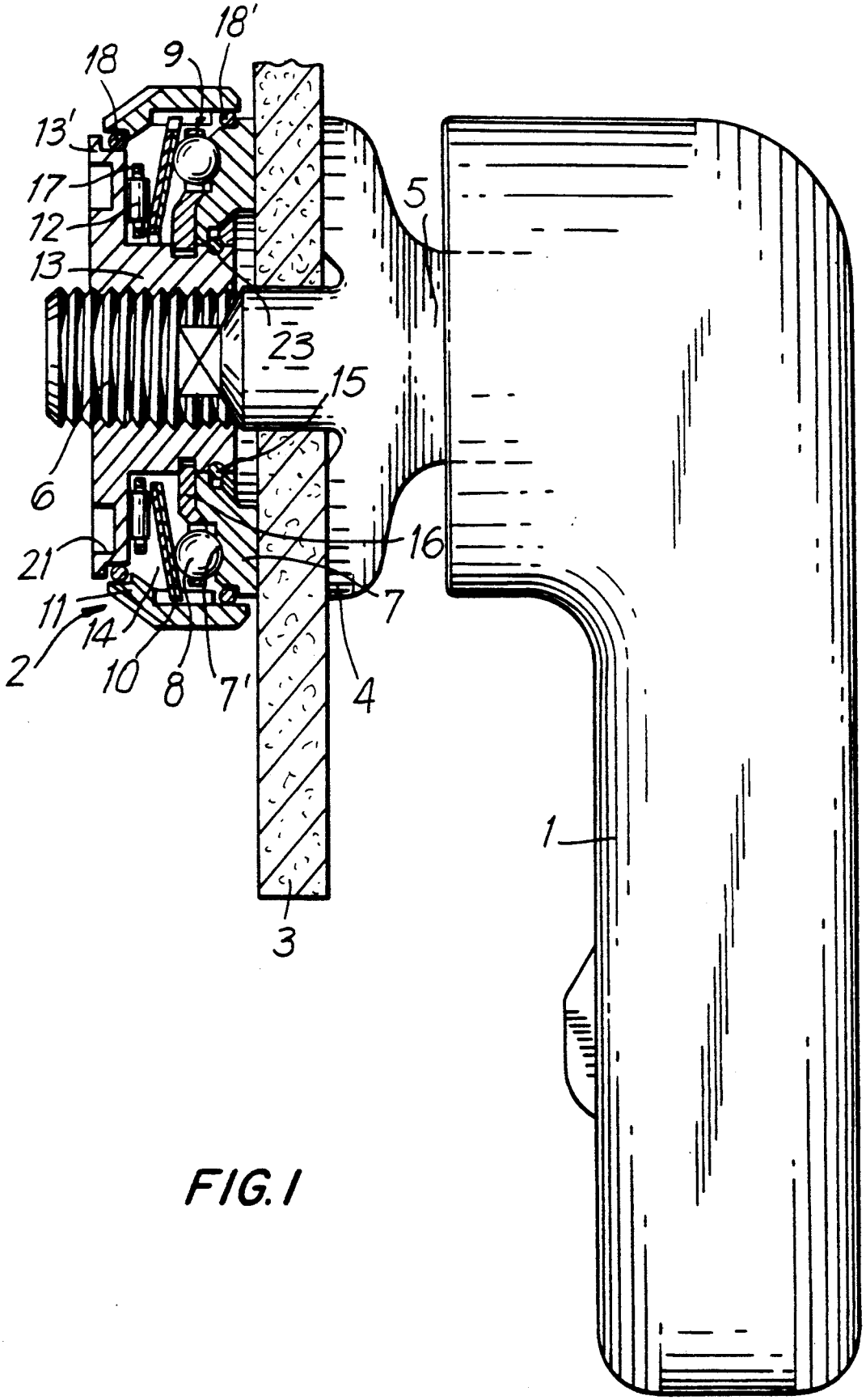
FIG. 1 is a partially cross sectional, partially side view of a first embodiment of a hand power tool with a chuck according to the invention.

The hand power tool 1 shown in FIG. 1 has a quick-action chuck which holds a disc shaped tool 3, in particular a grinding disc, against a shoulder 4 of a drive spindle 5. The quick-action chuck 2 is screwed onto a thread 6 of the drive spindle 5 of the hand power tool 1.

A ring-shaped pressure plate 7 of the quick-action chuck 2 transmits the chucking force of the latter to the tool 3. The pressure plate 7 is provided with an annular groove 7' of circular arc profile, on the side away from the tool. Spherical roll bodies 8 of a first rolling contact bearing 9, provided with a cage 16, are carried in this groove such as to allow their rolling movement. On the side of the rolling bodies 8, away from the groove 7', an inner ring-shaped disc spring 10 serves as a running surface. This spring is positively coupled at its outer diameter, locking with a hand screw part 11. A second rolling contact bearing 12, provided with a cage 17, rests rollable between the disc spring 10 and a front face of a threaded part 13 of the quick-action chuck 2.

The pressure plate 7 concentrically surrounds the threaded part 13 like a ring and is secured against axial displacement in relation to the threaded part by a retaining ring 15. The hand screw part 11 surrounds the pressure plate 7 and the threaded part 13 like a sleeve and, by virtue of appropriately designed stop-type projections 13' and by sealing rings 18,18', it is axially secured in its position relative to these. With the described arrangement of the pressure plate 7, the threaded part 13, and the hand screw part 11, an annulus 14 is formed within the quick-action chuck 2. The arrangement of the retaining ring 15, seated in a groove 23 in the threaded part 13 ensures that the above mentioned parts are axially secured in their position in relation to each other.

A decisive factor for the function in accordance with the invention of the previously described design is the torsionally stiff form-fit between the cage 16 of the first rolling contact bearing 9 and the threaded part 13.

Chucking of a tool by means of the quick-action chuck 2 is effected as follows: By turning the hand screw part 11, the entire quick-action chuck 2 is moved in a screwing action—in the direction of the tool 3—until the pressure plate 7 rests against the tool 3, i.e. a frictional connection is achieved. During this first screwing phase, the threaded part 13 is turned synchronously with the hand screw part 11, until the friction between the threaded part 13 and the thread of the drive spindle 5, and between the pressure plate 7 and the tool 3, respectively—hereafter described as "external" friction—is less than the friction of the parts which form a rolling planetary drive within the annulus 14—hereafter described as the "internal" friction.

As soon as the "external" friction exceeds the "internal" friction, the action of the rolling planetary gear starts as follows: The pressure plate 7 remains stationary in relation to the tool 3. The rolling bodies of the rolling contact bearing 9, roll on the pressure plate 7, driven by the disc spring 10 and the hand screw part 11. In doing so, the rolling bodies 8 transmit the rotating motion of the cage 16 to the threaded part 13. In accordance with the laws of rolling planetary gears, the threaded part 13 moves at half the rotational speed of the hand screw part 11. Coupled with this reduction is an increase of the transmittable torque to twice the input torque acting on the hand screw part 11, i.e. with minor actuating force on the hand screw part 11, a high tightening moment is achieved on the threaded part 13. This is restricted to the maximum tightening moment that is achievable by hand.

The rolling planetary drive action, which is like that of a friction clutch, in conjunction with the bearing 12, makes automatic tightening of the quick-action chuck beyond the maximum tightening moment impossible: if the brake moment between the tool 3 and a work piece to be treated is greater than the clamping moment which acts between the shoulder 4 and the pressure plate 7, then the tool 3 turns relative to the tool spindle 5, carrying with it the pressure plate 7. The threaded part 13, meanwhile, is stationary, relative to the tool spindle, the hand screw part 11 turns at twice the speed of the pressure plate 7.

By appropriate design of the rolling planetary drive, in particular by preloading and dimensioning of disc spring 10 or 19, dimensioning of rolling bodies 8, and by appropriate selection of the material, the size of the moment to be transmitted can be closely specified.

In order to seal the annulus 14 and hence the rolling planetary drive against dust and humidity, sealing rings 18, 18' are arranged, which have areas 18,, to be sealed on the hand screw part 11 and on the threaded part 13 allocated to them.

For extreme cases with particularly harsh operating conditions, i.e. with a likelihood of rust locking the threaded part 13 on the drive spindle 5, the threaded part 13 should be provided with engaging points 21 which facilitate the use of a separate tool for slackening the quick-action chuck 2.

Figure 2:
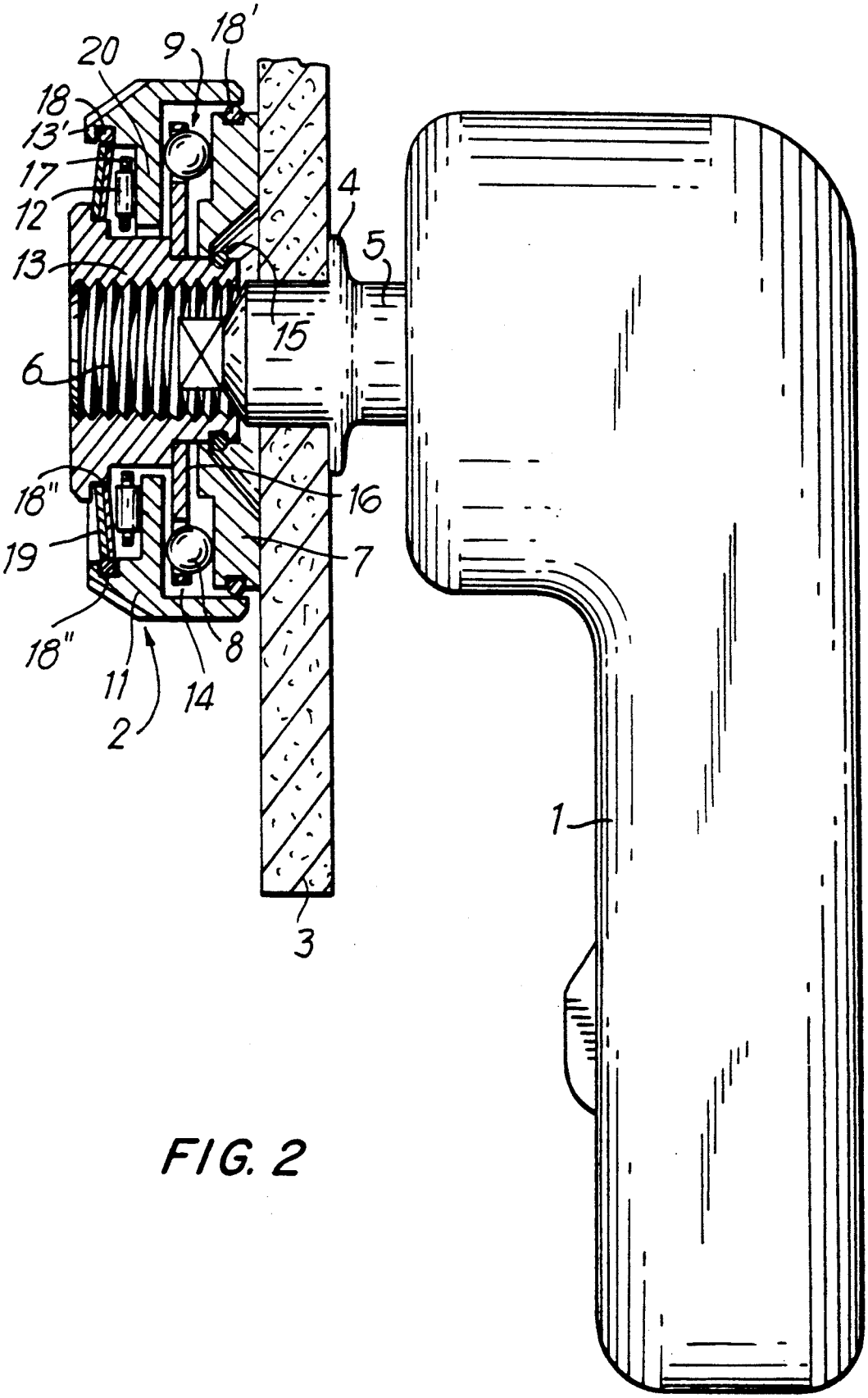
FIG. 2 is a partially cross sectional, partially side view of a second embodiment of a hand power tool with a chuck according to the invention.

In the second embodiment illustrated in FIG. 2, the rolling contact bearing 9, in contrast to FIG. 1, is in immediate friction contact with the hand screw part 11, as if the inner disc spring 10 of FIG. 1 were a rigid, one-piece component of the hand screw part 11 in the form of a projection 20. The second rolling contact bearing 12 is arranged rollable between the projection 20 and an external disc spring 19.

The external disc spring 19 is tensioned on the one side by the rolling contact bearing 12 and on the other side by the threaded part 13, supported against a stop-like projection 13'. The arrangement of the disc spring 19 is for tolerance compensation within the quick-action chuck and for providing the minimum friction engagement necessary for a rolling planetary drive.

The internal disc spring 10 of FIG. 1 has the same function as the external disc spring 19. This has the effect that for the operation of the quick-action chuck 2, a radial force acting on the hand screw part 11 is sufficient, without any additional axial force required.

With all embodiments, it is possible to use ball, roller or needle bearings as rolling contact bearings, as required.

The quick-action chuck 2 can be configured as a screw rather than a nut.

While the invention has been illustrated and described as embodied in a hand power tool with a multi-part, manually operable quick-action chuck, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. In a hand power tool (1) comprising a disc-shaped tool (3), a drive spindle (5) and a manually-operable chuck (2) securable to said drive spindle (5) to hold the disc-shaped tool (3) on the drive spindle (5), said chuck including a threaded part (13); a pressure plate (7) concentrically embracing the threaded part (13) and bearing against said disc-shaped tool (3) to force load said disc-shaped tool (3) when said chuck (2) is tightened, said pressure plate (7) being held in position axially and rotatable in relation to the threaded part (13); a hand screw part (11) shaped like a sleeve and positioned in relation to the threaded part (13) and the pressure plate (7) so as to form an annulus (14); at least one rolling contact bearing (9,12) arranged in the annulus (14), and a drive which couples together the hand screw part (11), the threaded part (13) and the pressure plate (7), the improvement wherein the drive is a rolling planetary drive.

2. The improvement as defined in claim 1, further comprising spring means and wherein at least one of the rolling contact bearings (9,12) and the spring means forms a drive element, which couples the pressure plate (7), the threaded part (13) and the hand screw part (11).

3. The improvement as defined in claim 2, wherein the spring means comprises a disc spring (10).

4. The improvement as defined in claim 2, wherein the rolling contact bearing (9) has rolling bodies (8) and the rolling bodies (8) of the rolling contact bearing (9)

are coupled with the threaded part (13) so as to provide transmission of movement.

5. The improvement as defined in claim 4, further comprising a frictional connection between the threaded part (13) and a rolling contact bearing (9), and also between the rolling bodies (8) of the rolling contact bearing (9) and the pressure plate (7).

6. The improvement as defined in claim 5, further comprising a retaining ring (15) fitted in the threaded part (13) in the vicinity of the pressure plate (7).

7. The improvement as defined in claim 6, further comprising sealing rings (18,18') placed in grooves for sealing the annulus (14) in a friction contact.

8. The improvement as defined in claim 7, wherein the spring means comprises a disc spring (10) and one of the rolling contact bearings (9) is an axial ball bearing resting against the pressure plate (7), which axial ball bearing runs on a front face of the disc spring (10), and another of the rolling contact bearings (9) is provided and is an axial roller bearing resting against a threaded part (13), which axial roller bearing runs on another front face of the disc spring (10).

9. The improvement as defined in claim 8, wherein the disc spring (10) is constructed as a one-piece projection (2) of the hand screw part (11), and further comprising another disc spring (19) braced between the threaded part (13) and the axial roller bearing (12) and at the same time constitutes a running surface for the axial roller bearing (12).

10. The improvement as defined in claim 9, wherein the disc spring (19) is in friction connectional with the sealing ring (18), said sealing ring being in the hand screw part (11).

11. The improvement as defined in claim 1, wherein the rolling planetary drive is a recirculating ball drive.

* * * * *